US007063218B2

(12) United States Patent
Pleiman et al.

(10) Patent No.: US 7,063,218 B2
(45) Date of Patent: Jun. 20, 2006

(54) ANTI-TIP RACK FOR LONG HANDLED TOOLS

(75) Inventors: Brian Ralph Pleiman, Medina, OH (US); David M. Stitchick, Akron, OH (US)

(73) Assignee: Rubbermaid Incorporated, Fairlawn, OH (US)

( * ) Notice: Subject to any disclaimer, the term of this patent is extended or adjusted under 35 U.S.C. 154(b) by 0 days.

(21) Appl. No.: 11/219,493

(22) Filed: Sep. 2, 2005

(65) Prior Publication Data

US 2006/0000789 A1 Jan. 5, 2006

Related U.S. Application Data

(63) Continuation of application No. 10/627,434, filed on Jul. 25, 2003, now Pat. No. 6,983,854.

(60) Provisional application No. 60/398,752, filed on Jul. 26, 2002.

(51) Int. Cl.
*A47F 7/00* (2006.01)

(52) U.S. Cl. ..... 211/70.6

(58) Field of Classification Search ..... 211/70.6, 211/70.8, 87.01, 65, 60.01; 248/108–111; D6/552, 469; 200/443, 446, 558, 563, 564; 220/512, 519, DIG. 6
See application file for complete search history.

(56) References Cited

U.S. PATENT DOCUMENTS

| | | | |
|---|---|---|---|
| 337,767 | A | 3/1886 | House |
| 1,915,020 | A | 6/1933 | Goldstein |
| 2,587,226 | A | 2/1952 | Rodman |
| 2,596,749 | A | 5/1952 | Webber |
| D169,077 | S | 3/1953 | Mains |
| 2,835,503 | A | 5/1958 | Humphries et al. |
| 3,298,531 | A | 1/1967 | Wilcke |

(Continued)

FOREIGN PATENT DOCUMENTS

| | | |
|---|---|---|
| DE | 44 36 292 A1 | 4/1996 |

(Continued)

OTHER PUBLICATIONS

International Search Report dated Dec. 16, 2003.

(Continued)

*Primary Examiner*—Hugh B. Thompson, II
(74) *Attorney, Agent, or Firm*—Marshall, Gerstein & Borun LLP

(57) ABSTRACT

A long handled tool storage device has a base panel with a top surface, a base perimeter that defines a base panel size and shape, and a bottom side arranged so that the base perimeter rests on a ground surface when the storage device is in use. Two sides of the base panel are joined together at first ends thereof to generally define a rear corner and a front side spanning between second ends of the two sides. A plurality of tool handle receptacles are provided in the base panel and at least recessed downward relative to a plane of the top surface. A plurality of risers extend upward from the base panel. An upper panel has a perimeter that defines an upper panel size and shape. The upper panel is supported by the risers above and spaced from the top surface of the base panel. A plurality of tool handle openings are formed through the upper panel. At least a portion of the front side of the base panel extends outward away from the rear corner and beyond a linear reference extending between the second ends of the two sides.

7 Claims, 6 Drawing Sheets

U.S. PATENT DOCUMENTS

| | | | | |
|---|---|---|---|---|
| 3,643,812 | A * | 2/1972 | Mander et al. | 211/74 |
| 3,759,538 | A | 9/1973 | Fabiano | |
| 3,762,594 | A | 10/1973 | Utz | |
| 5,011,028 | A | 4/1991 | Sweeney | |
| 5,092,463 | A | 3/1992 | Dees | |
| 5,722,544 | A | 3/1998 | Williams | |
| 5,810,177 | A * | 9/1998 | Cabiran | 211/70.6 |
| 5,833,250 | A | 11/1998 | Schier et al. | |
| 6,178,896 | B1 | 1/2001 | Houk, Jr. et al. | |
| 6,250,480 | B1 | 6/2001 | McGuinness | |
| 6,398,045 | B1 | 6/2002 | Chao | |
| 6,460,709 | B1 * | 10/2002 | Hurt | 211/87.01 |
| 6,508,369 | B1 * | 1/2003 | Wang | 211/60.1 |

FOREIGN PATENT DOCUMENTS

| | | |
|---|---|---|
| GB | 2 018 343 A | 10/1979 |
| WO | WO 01/98037 A1 | 12/2001 |

OTHER PUBLICATIONS

PCT International Preliminary Examination Report issued in PCT/US03/23371 mailed Nov. 26, 2004.

PCT Written Opinion issued in PCT/US03/23371, mailed Sep. 29, 2004.

* cited by examiner 32
112
142c
142c
142c
142b
142c
34
34
142d
142d
144
142e
142e
144
144
144
142a
142c
142
36
36
142f
30
142c 18
10
14
52
16
16
44
12
28

72
18
46
142
48
144
74

ANTI-TIP RACK FOR LONG HANDLED TOOLS

RELATED APPLICATION DATA

This patent is a Continuation of U.S. patent application Ser. No. 10/627,434, which was filed on Jul. 25, 2003, now U.S. Pat. No. 6,983,854 and which claimed priority benefit of U.S. Provisional Application Ser. No. 60/398,752, which was filed on Jul. 26, 2002.

BACKGROUND OF THE INVENTION

1. Field of the Invention

The present invention generally relates to tool storage devices, and more particularly to a tool rack with an anti-tipping feature for storing long handled tools.

2. Description of the Related Art

Tool storage devices and tool racks are known for storing a wide variety of tools. Long handled tools such as shovels, rakes, and the like are often stored by hanging them on a wall using nails or on a peg board using hooks. Storage racks are also known for storing long handled tools. One type of rack has an elevated perimeter frame made of heavy gage metal or heavy wood. The frame supports a grid surface spanning the frame. A number of openings are provided in the grid surface. A tool handle is placed through one of the openings until the bottom end of the handle rests on the ground. The perimeter of the particular opening supports the tool in a generally upright position.

The tools may be supported in this prior rack orientation non-vertically, or in other words, leaning relative to vertical. If a number of tools are stored in this manner and lean in the same direction, a significant moment or force can be created. A rack could possibly tip over. However, even if such prior racks were fully loaded and all tools therein were tilted in a similar orientation, the combined moment or force applied to the rack would not be sufficient to tip the rack. This is because the heavy steel or wood frame and supports can counteract the moment generated by the leaning tools.

A typical rack also has no reference to assist in orienting multiple tools in a manner that would prevent such a tool arrangement from occurring. Further, these types of racks do not have a feature to assist in vertically orienting each tool in the rack. Thus, it is likely that tools will be stored leaning relative to vertical, and often with many or all of the tools leaning in the same direction. The lack of an installation reference to assist users in loading tools into the rack in a vertical orientation also can result in such a tool arrangement.

Heavy wood or metal storage racks are undesirable in that they can be difficult to move, carry, assemble, and disassemble. Also, material and manufacturing costs can be excessive. Making a rack out of a lightweight material such as plastic and having a prior rack construction can be done to reduce the weight of the rack. However, such a light weight plastic rack will tip over much more easily that a heavy framed rack if not loaded with particular care to avoid a tipping moment.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

Examples of anti-tip storage devices for long handled tools are disclosed and described herein. The devices generally have a base panel, an upper panel, and a plurality of risers supporting the upper panel above the base panel. A plurality of tool handle receptacles are provided in the base panel. A corresponding plurality of tool handle openings are provided through the upper panel. The anti-tip tool rack is designed so that it does not easily tip over regardless of the number, arrangement, weight, length, and orientation of tools stored in the device. The disclosed rack construction is well suited for use with metal and wood materials. The disclosed construction is particularly well suited for use with lightweight materials, such as plastics and thermoplastics.

Figure 1:
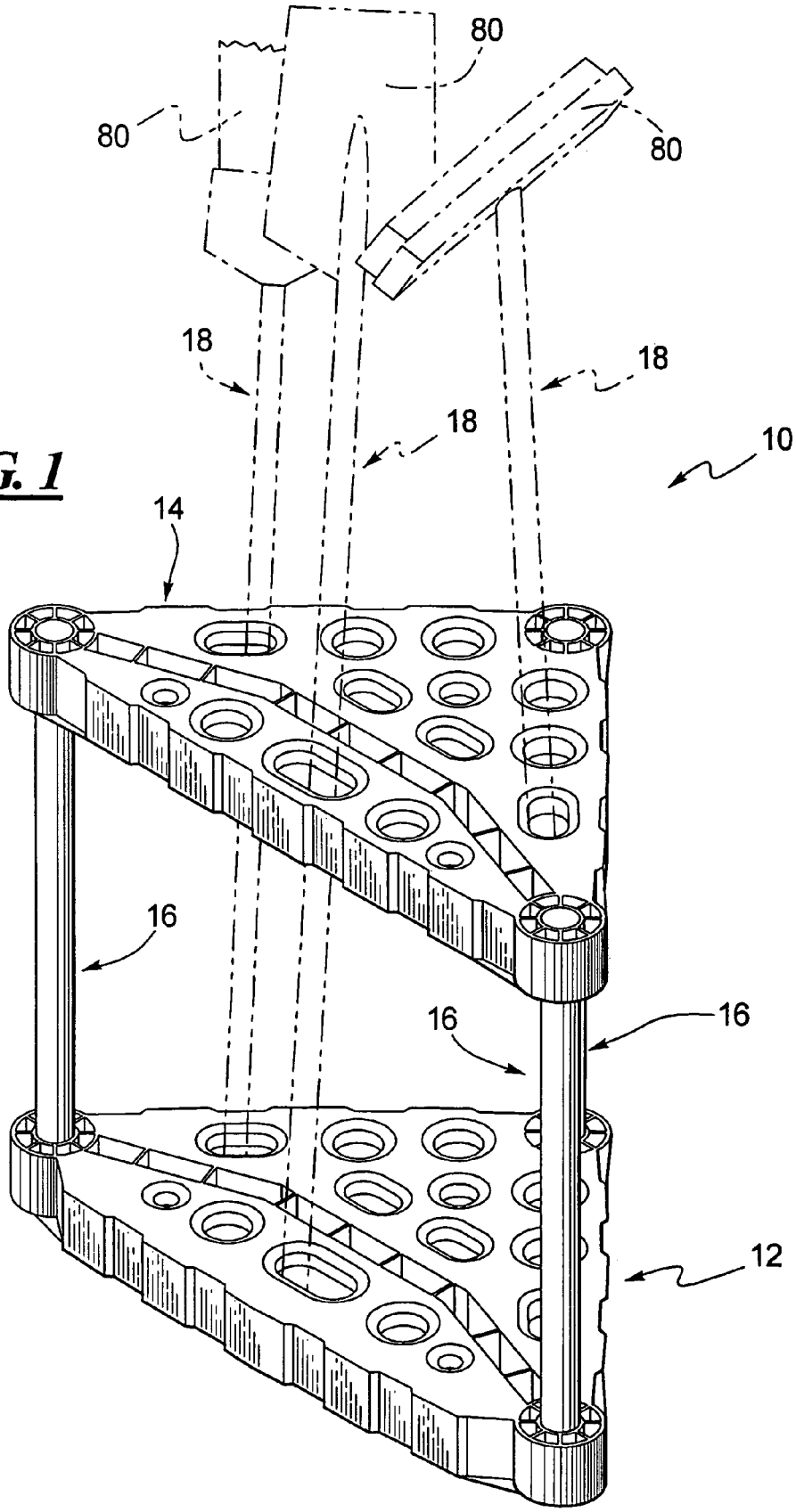
FIG. 1 is a perspective view of one example of a storage device for long handled tools constructed in accordance with the teachings of the present invention.
Figure 2:
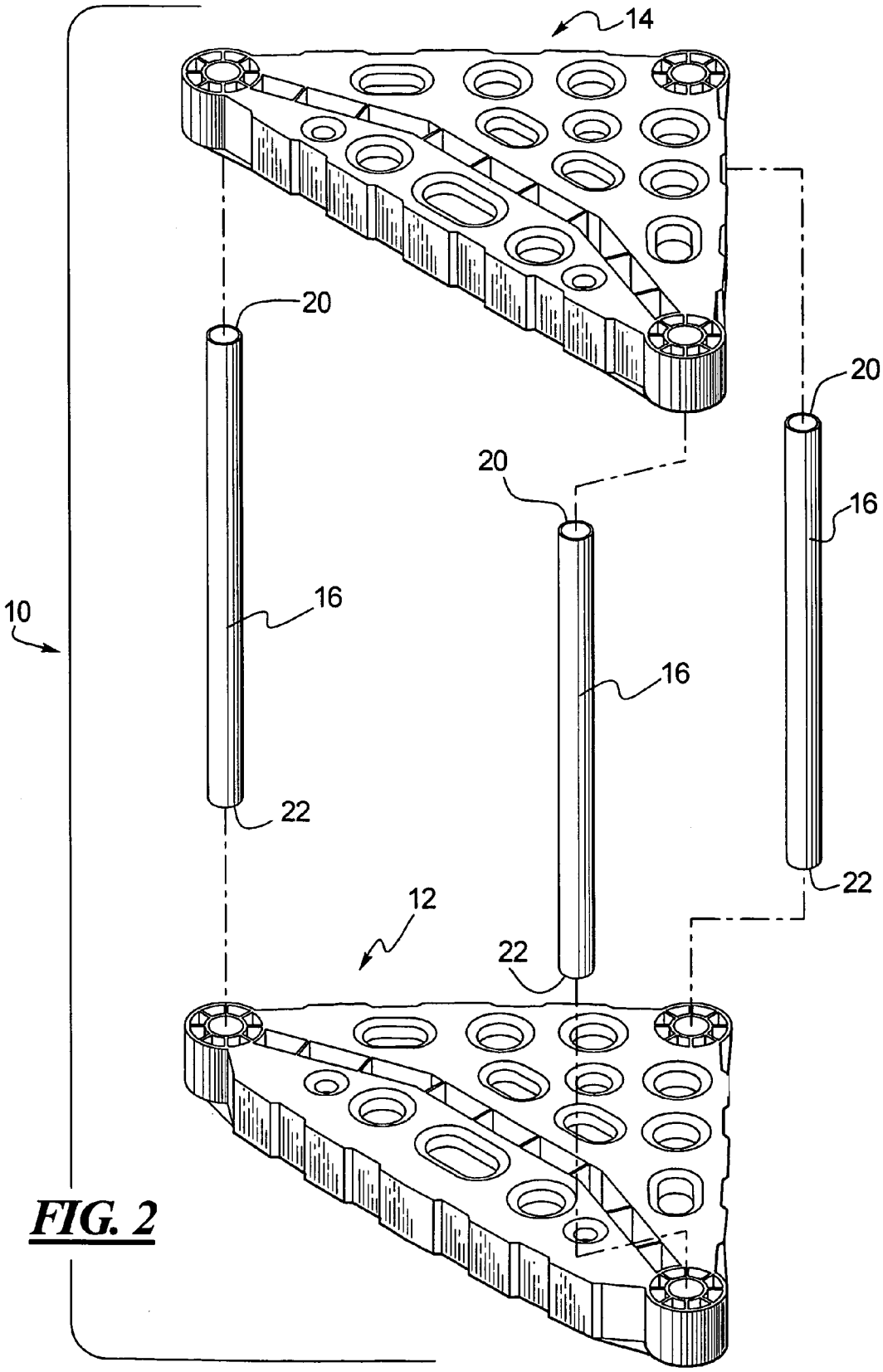
FIG. 2 is an exploded perspective view of the storage device of FIG. 1.
Figure 3:
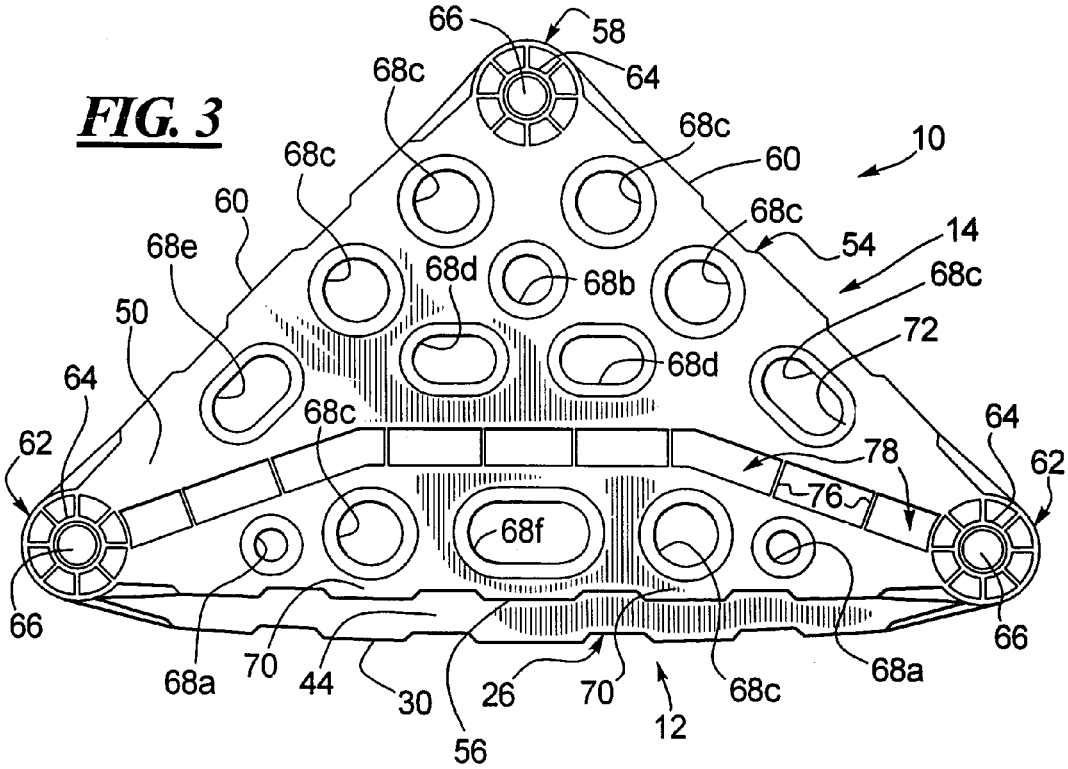
FIG. 3 is a top view of the assembled storage device of FIG. 1 including the upper panel portion.

Turning now to the drawings, FIGS. 1–3 illustrate one example of an anti-tip storage device 10 constructed in accordance with the teachings of the present invention. The device 10 generally has a base panel 12, an upper panel 14, and a plurality of risers 16 supporting the upper panel above and spaced from the base panel. A plurality of long handled tools 18 (shown in phantom in FIG. 1) can be stored in the device 10. The position, arrangement, size, variety, and quantity of the tools can vary at any given time. The tools 18 can be easily placed in and removed from the device 10 as needed.

As shown in FIGS. 1 and 2, a plurality of the risers 16 interconnect the base panel 12 and upper panel 14 to assemble the device 10. Each riser 16 has an upper end 20 coupled to a portion of the upper panel 14, and a lower or base end 22 coupled to a portion of the base panel 12. The height of the risers 16 determines the spacing between the panels and ultimately determines the height of the upper panel relative to the ground surface G.

In the present example as shown in FIG. 1 and the top view of FIG. 3, the assembled storage device 10 generally forms a triangular cylinder adapted for use in a corner of a room. Thus, three risers 16 are provided, one for each corner of the triangular shaped panels 12 and 14. As will be evident to those having ordinary skill in the art, the number of risers can vary depending upon the shape of the device and the panels, the size or surface area of the panels, and/or the particular usage of the device. If the device 10 is relatively large, one or more risers can be provided interior to the perimeter of the panels to provide additional support for the panels and stability for the device, if desired.

The risers 16 disclosed in the present example are hollow circular cylinders fabricated from a suitable plastic or thermoplastic material. However, the type of material used to fabricate hollow risers can vary and can include steel, aluminum, or other metals, as well as polyethylene, polypropylene, polystyrene, or other plastic or thermoplastic materials. Alternatively, the risers 16 can be solid and formed from wood, plastic, metal, or the like. The risers 16 can also vary in shape from the circular cylinders disclosed. For example, the riser cross section can be rectangular, square, triangular, oval, elliptical, or the like. The risers 16 can also be formed utilizing any suitable process including extrusion, machining, casting, injection molding, blow molding, continuous molding, vacuum forming, or the like.

As will be evident to those having ordinary skill in the art, the risers 16 can be formed having virtually any suitable shape and configuration, from any suitable material, and using any suitable process, as long as they perform their intended function. The general functions of the risers 16 are to sturdily interconnect and support the upper panel 14 above the base panel 12, to space and align the panels relative to each other as intended, and to provide, if desired, a particular aesthetic appearance.

Figure 4:
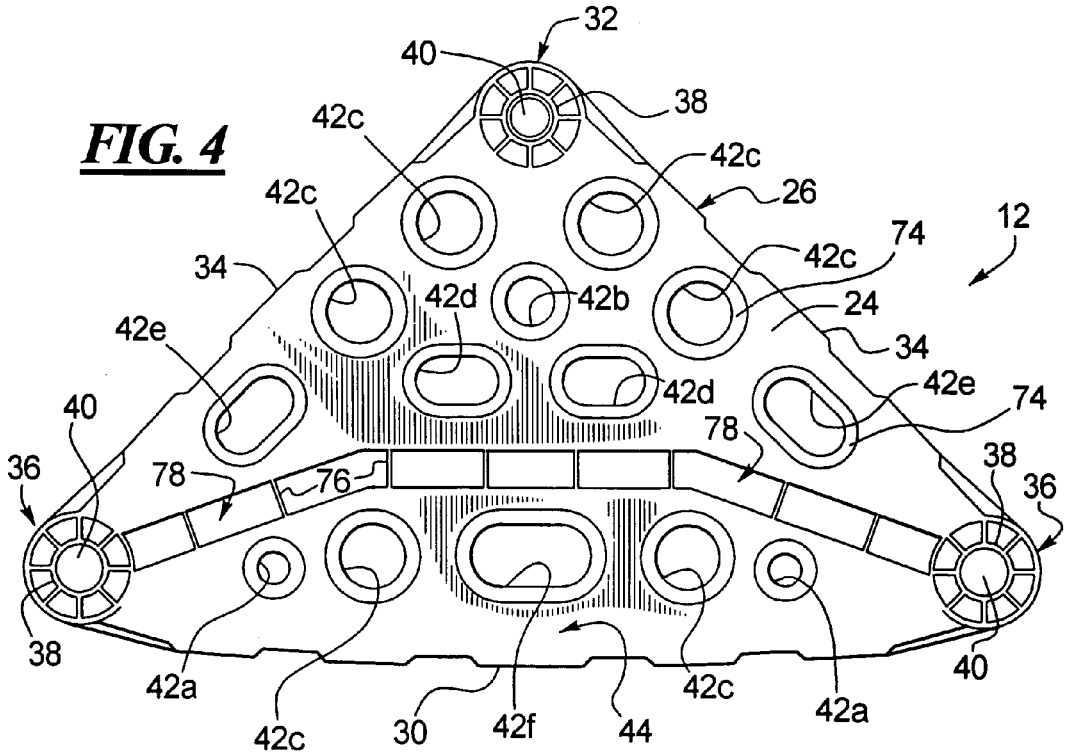
FIG. 4 is a top view of one example of a base panel portion of the storage device of FIG. 1 and as represented in FIGS. 2 and 3.

As shown in FIGS. 1, 2, and 4, the disclosed base panel 12 has an upward facing top surface 24 and a perimeter 26. The base panel has a bottom side 28 adapted for resting on the surface G. The base panel 12 in this example also has a base front end 30 defined by a portion of the perimeter 26 that faces forward when the device 10 is being utilized as described below. The base perimeter 26 defines a base footprint having a shape as best seen in FIG. 4. In this example, the device 10 is intended for placement in a corner of a room. The footprint is, therefore, generally triangular in this example. The base panel 12 has a back corner 32 that can be set in a corner of a room and has a pair of sides 34 that extend from the back corner. In this example, the sides 34 are arranged at a right angle (90°) relative to one another at the back corner 32.

The front end 30 of the triangular base panel 12 extends between the sides 34 opposite the back corner 32, thus forming two front corners 36. The front end 30 faces outward from a room corner and into the room environment. The front corners 36 and back corner 32 each define a socket 38 with a riser opening 40 formed therein for insertion of the lower end 22 of one of the risers 16. As will be evident to those having ordinary skill in the art, the sockets 38 can vary in size, shape, configuration, construction, and location according to the corresponding riser construction and the requirements for a particular storage device 10.

The base panel 12 has a plurality of tool handle receptacles 42. In the disclosed example, the receptacles 42 are through-holes passing completely through the base panel 12. The receptacles 42 include a number different shapes, orientations, and sizes, and are thus identified in the drawings as receptacles 42*a*, 42*b*, 42*c*, 42*d*, 42*e*, and 42*f*. Some of the receptacles are circular (42*a*–*c*) and of different size, and some are oval (42*d*–*f*) and of different size and orientation. As will be evident to those having ordinary skill in the art, the number, shape, size, and orientation of the discrete receptacles can vary from the example shown and yet fall within the scope and spirit of the present invention. Some or all of the receptacles 42 in a given base panel 12 can be the same shape, and/or the same size, and/or the same orientation, if desired for a particular application. Alternatively, the receptacle shapes and sizes can vary over a given panel and can include different, even asymmetrical, geometric shapes.

Figure 9:
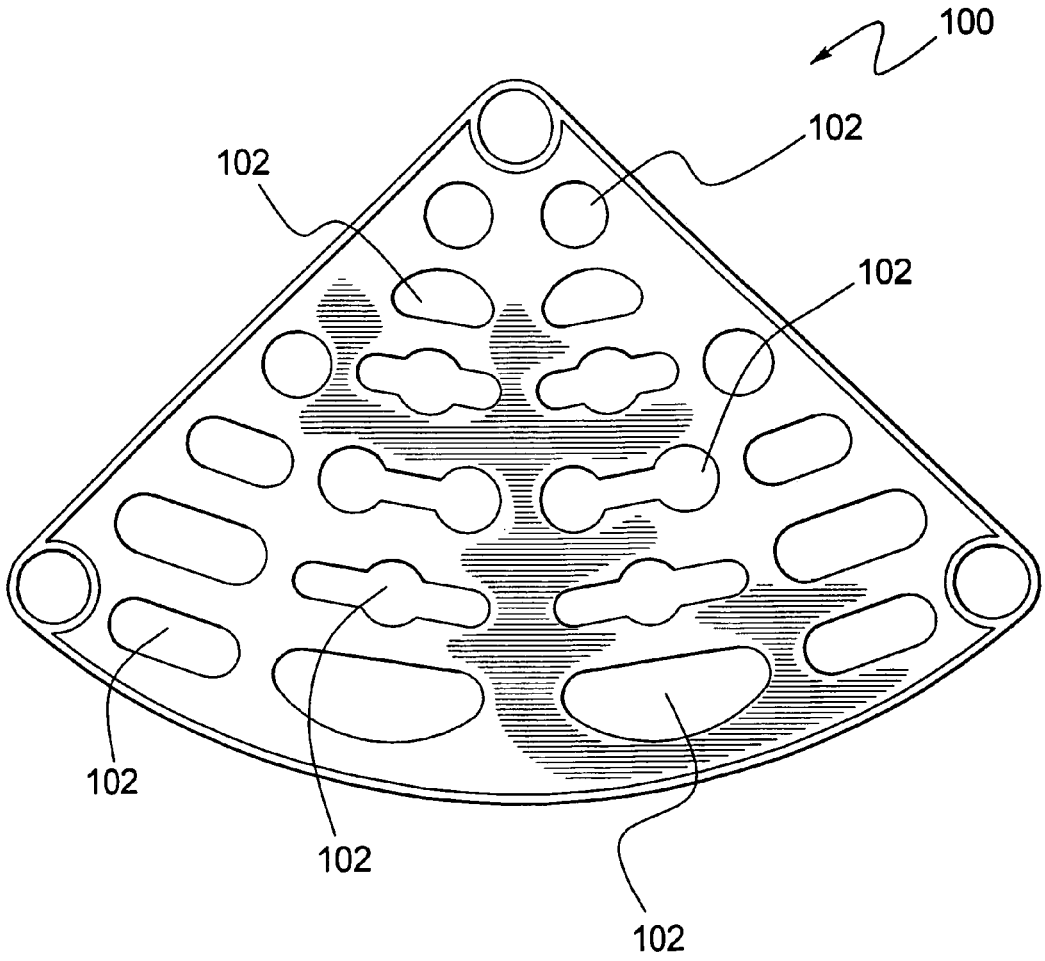
FIG. 9 is a top view of another example of a storage device upper panel portion constructed in accordance with the teachings of the present invention.

As one of many possible examples, FIG. 9 illustrates one such a panel. An alternative panel 100 is illustrated with a different opening/receptacle configuration. The openings or receptacles 102 are of different shape and arrangement than those described previously. The receptacles can be configured to match a particular type of tool handle or tool shape, or to permit variable tool handle positioning within the receptacle as desired.

As shown in FIG. 2, a forward extension or toe 44 is provided between the front end 30 and the forward most receptacles 42 in the base panel. The depth or spacing of the toe 44 can vary considerably, but in the disclosed example provides an anti-tip characteristic to the rack as described below. The toe or extension 44 as disclosed in this example can either correspond to or be different than a similar spacing or extension on the upper panel 14. In one example, only the base panel 12 has a toe extension 44 to assist in creating an anti-tip characteristic as described below. However, the upper panel can have a similar extension to permit utilizing the identical part for both the upper and base panels, if desired.

In the example shown in FIG. 4, the plurality of tool handle receptacles 42 are through-holes that pass completely through the base panel. Each tool 18 has an elongate handle 46 with a distal end 48. When in use, the distal end 48 of a tool 18 in this example will pass through the receptacle 42 and rest directly on the surface G. As discussed below, one anti-tip characteristic can be provided by the vertical positioning or alignment of the receptacles 42 relative to those in the upper panel.

As shown in FIGS. 1–3, the disclosed example of the upper panel 14 has an upward facing top surface 50 and a bottom surface 52 that is spaced upward from and faces the base panel 12. The upper panel 14 also has an upper panel perimeter 54 and an upper panel front end 56 defined by the perimeter. The upper panel front end 56 is also intended to face forward in the same direction as the base front end 30 when the device 10 is utilized. The upper panel perimeter 54 defines an upper panel shape which, in the disclosed example, is substantially similar to the base footprint. Thus, the upper panel 14 has a back corner 58, a pair of sides 60, a pair of front corners 62 at the juncture between the front end 56 and the sides 60. Sockets 64 define riser openings 66 and are provided in the front corners 62 and back corner 58 of the upper panel 14 for insertion of the upper ends 20 of the risers 16.

In this example, the upper panel shape and the base footprint essentially mirror one another, except for differences in the respective front ends 30 and 50, as described below. As will be evident to those having ordinary skill in the art, the upper panel shape can also vary considerably and yet fall within the spirit and scope of the invention. It is preferred, but not necessary, that the upper and base panels are essentially the same shape. This is because, for storing long handled tools, the number and placement of tool storage regions (described below) in the two panels should generally match. Otherwise, tools may be stored in incorrect or miscellaneous orientations, which could affect the anti-tipping characteristics.

The upper panel 14 has a plurality of tool handle openings 68. In the disclosed example, the openings 68 also include a number different shapes, orientations, and sizes that correspond with the receptacles 42 of the base panel 12. Thus, the openings 68 are identified in the drawings as openings 68*a*, 68*b*, 68*c*, 68*d*, 68*e*, and 68*f*, similar to the corresponding receptacles 42. Some of the openings are circular (68*a–c*) and of different size, and some are oval (68*d–f*) and of different size and orientation. As will be evident to those having ordinary skill in the art, the number, shapes, sizes, and orientations of the openings can vary, similar to the base panel 12, from the example shown and yet fall within the scope and spirit of the present invention.

As shown in FIG. 2, a front end extension 70 is defined between the front end 56 and the forward most receptacles 68 in the upper panel 14. This spacing or extension 70 is different than the toe extension 44 in the base panel 12 in the disclosed example for reasons discussed below. However, the front end extension 70 can be the same as the toe extension 44 of the base panel 12.

The openings 68*a–f* of the upper panel 14 in this example are vertically aligned with the corresponding receptacles 42*a–f* of the base panel 12. However, in other alternatives, each set of opening and corresponding receptacle can be vertically misaligned or offset relative to one another. This can be done to achieve a particular lean angle and/or direction for the long handled tools 18 stored in the device 10 in order to achieve one anti-tip characteristic as discussed below. The receptacles 42 can be positioned slightly forward, laterally sideways, or rearward of the corresponding openings 68 in the assembled device 10. In addition, each set or pair of corresponding openings and receptacles can have a different offset, relative to position and/or distance, than the other sets or pairs, if desired to further enhance or control the anti-tip characteristics of the device 10.

Figure 8:
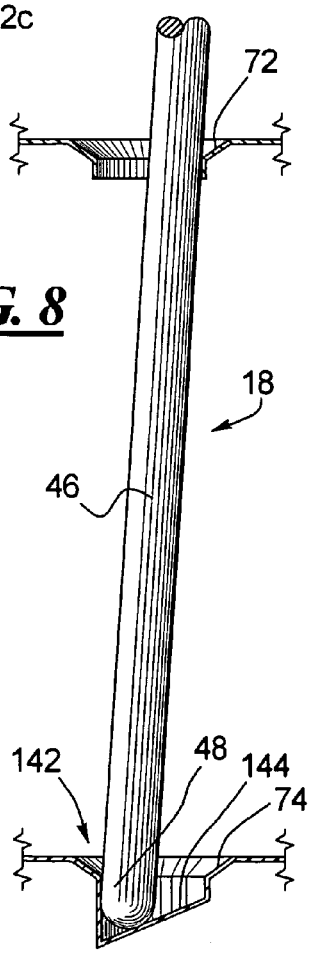
FIG. 8 is an enlarged cross section through the portion of the storage device of FIG. 7 holding the long handle tool.

In this example, each of the tool handle openings 68 has a beveled entry 72, as best seen in FIGS. 1, 2, and 8. The beveled entry 72 can be optionally provided to assist a user of the device 10 by guiding a tool handle 46 into and through the opening 68 when in inserting a tool 18 into the device. The receptacles 42 can also have beveled entries 74 as shown in FIG. 8, if desired.

As will be evident to those having ordinary skill in the art, the panels 12 and 14 can be fabricated from any suitable materials and using any suitable process. In one example, the panels are fabricated from molded plastic or thermoplastic. However, the materials can include wood, steel, polyethylene, polypropylene, polystyrene, or other plastic or thermoplastic materials. The processes can include stamping, machining, blow molding, continuous molding, injection molding, extruding, vacuum forming, or the like. Strengthening ribs 76, open pockets 78, or other strengthening and/or weight saving structures can be added to the plastic material or other panel materials to increase rigidity and strength while saving material, weight, and cost.

Figure 5:
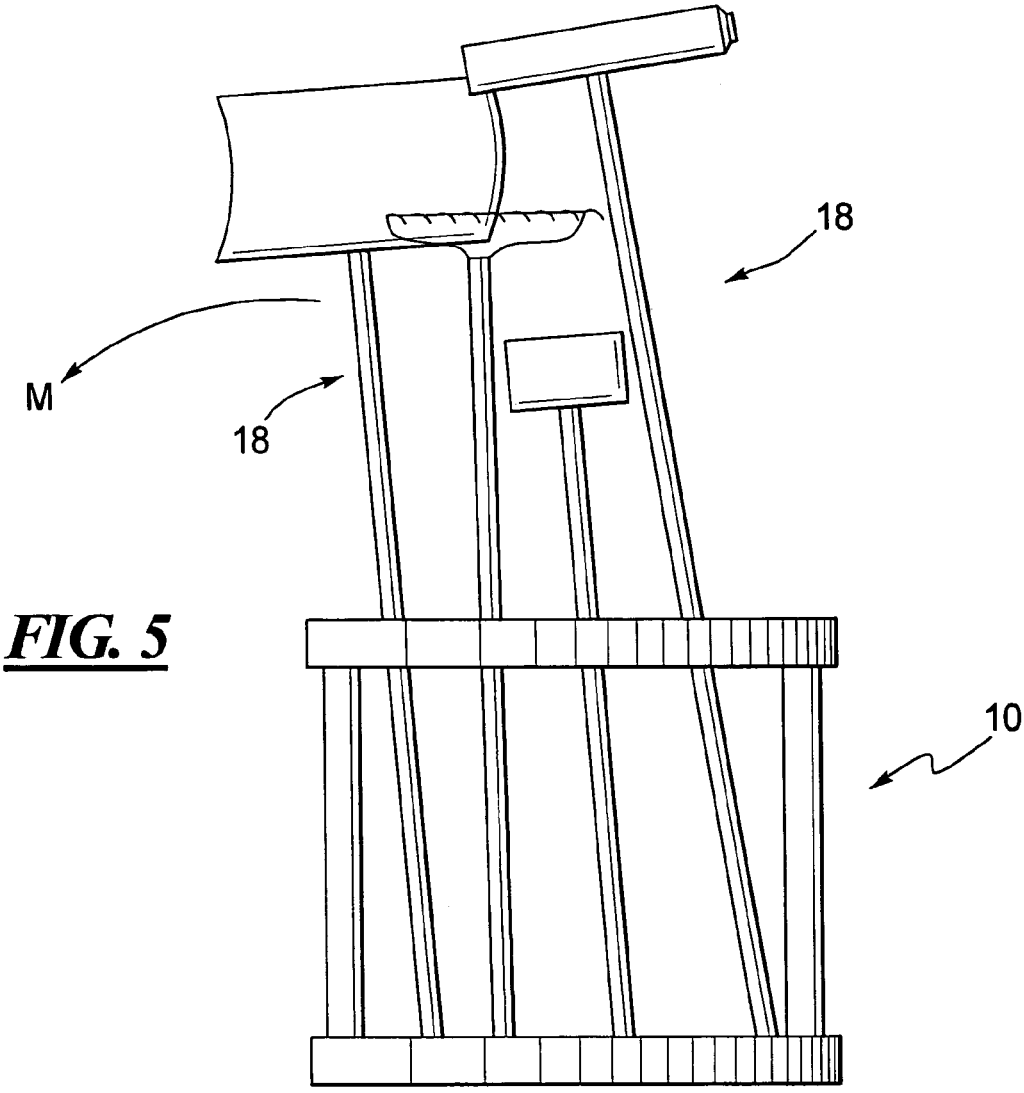
FIG. 5 is a side view of the storage device of FIG. 1 loaded with long handle tools and showing a representation of the resultant tipping moment.

The device illustrated in FIGS. 1–4, when fully loaded with long handle tools can be unstable and susceptible to tipping over. The present disclosure is intended to increase or add stability to such a device 10 by implementing one or more anti-tipping characteristics, which counteract the tipping moment or forces which would otherwise cause such instability. FIG. 5 schematically depicts a long handle tool rack device 10 which is loaded in such an unstable manner. Each tool 18 has a tool implement 80 disposed on the handle 46 opposite the handle distal end 48. These implements 80 can be quite heavy. When the device 10 is loaded with tools 18, the combination of the implements 80 and similar tilting directions of the tools can create a tipping moment M in the device. Because a plastic or lightweight rack construction does not inherently counter this moment M, various features and characteristics are disclosed herein to assist in doing so.

Figure 6:
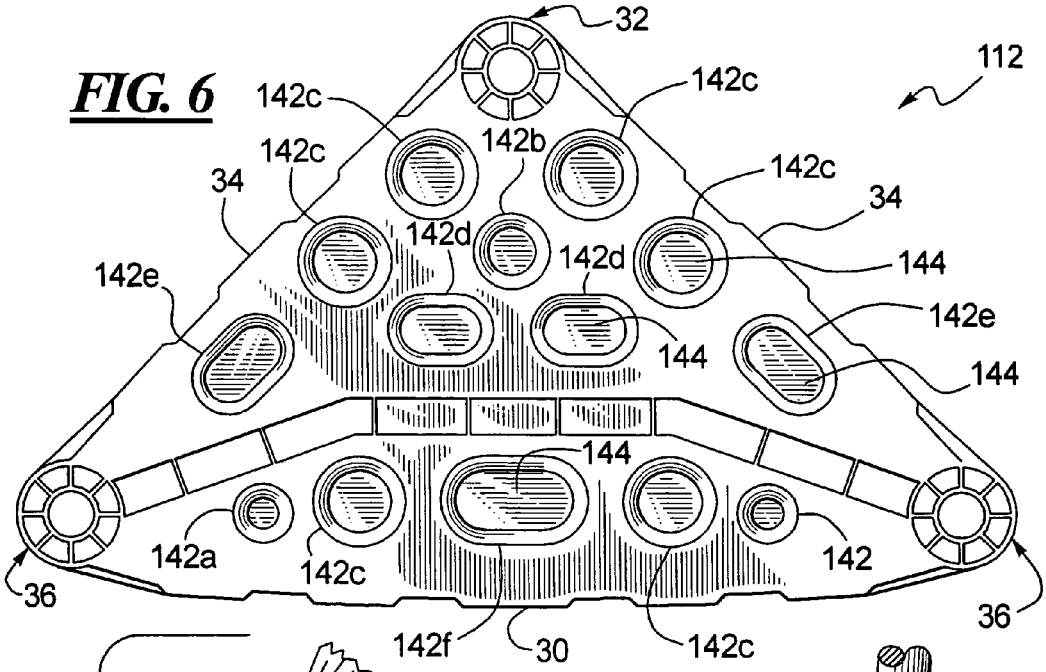
FIG. 6 is a top view of an alternative example of a base panel portion of the storage device similar to that shown in FIG. 1.

As best shown in FIGS. 3 and 6, one anti-tip feature or characteristic in this disclosed example is provided by the toe extension 44 in the base panel 12. Depending upon the number and positioning of the openings 68 and receptacles 42, a distance or depth of the toe extension 44 can be determined that will suffice for a given device 10. The toe extension 44 is simply added base panel material disposed forward of the forward most receptacles 42 in the panel. By providing a deep enough toe extension, the base panel 12 can at least in part (or completely, if desired) counteract the tipping moment M.

In this example as best seen in FIG. 3, the base panel front end 30 projects further forward that the upper panel front end 56, forming the toe extension 44 in the base panel 12. The amount or depth of the extension can prevent or inhibit the storage device 10 from tipping over in a forward direction, even when fully loaded with top-heavy long handled tools 18.

Alternatively, the upper panel front extension 70 can be the same as or even greater than the toe extension 44 in the base panel 12. The distance of the extension 70 will not greatly affect the tipping moment, and because of the additional material, a longer extension 70 may be undesirable if the panels are made from a heavier material. Therefore, the base panel footprint and the upper panel footprint (defined by their respective perimeters 26 and 54) can be identical, but need not be. However, the toe extension must be of a sufficient depth to counteract the tipping moment M generated by a loaded device 10, especially when most or all of the tools 18 are leaning in the same or a similar direction. The size of the toe extension 44 in the base panel 12 can vary according to the needs of a particular rack (number of tools, base panel size, base panel material, etc.). In other words, the distance between the outermost or forward most receptacles 42 and the front end 30 in the base panel 12, i.e., the toe extension 44, must be sufficient to maintain a center of gravity of the loaded rack 10 sufficient to counteract a tipping moment M generated by the tools 18 loaded in the rack.

In an alternative disclosed example of a base panel 112 is shown in FIG. 6 with like numbers representing like parts in comparison to the panel 12 described above. The base panel 112 has a plurality of receptacles 142 which are similarly configured and arranged in comparison to the receptacles 42 of the base panel 12. Each receptacle 142 in the base panel 112 has a blind end or bottom surface 144. The receptacles 142, therefore, do not pass through the entire panel depth, but instead terminate at the blind end surface 144. The surface 144 of each receptacle 142 in this example is tapered or angled relative to a plane defined by the panel top surface 24. The surfaces 144 are angled downward in a forward direction (toward the front end 30 or front corners 36), as shown in FIG. 8. The angled surface 144 urges the distal end 48 of the tool handle 46 forward within each receptacle 142 as depicted in FIG. 8, which provides another anti-tip feature or characteristic of the storage device 10.

Figure 7:
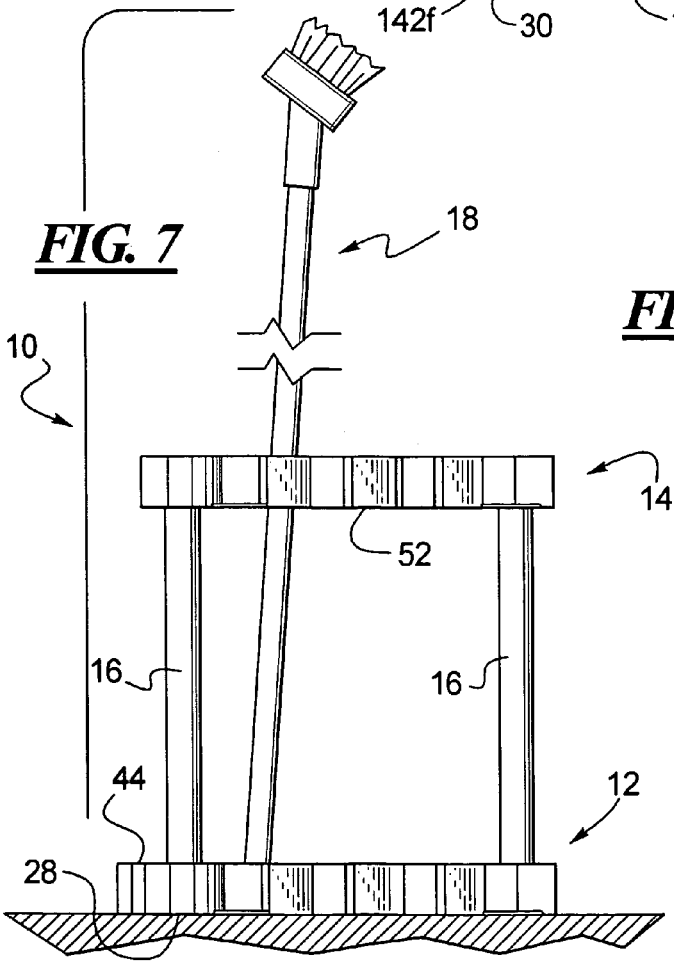
FIG. 7 is a side view of a storage device constructed using the base panel shown in FIG. 6 and having a long handled tool stored therein.

As shown in FIG. 8, the tapered surfaces 144 urge the distal ends 48 of the handles 46 forward within the receptacles 142. The forward most position of the handle ends 48 causes the tools 18 to tip rearward. The center of gravity for the device 10 can thus be controlled by urging each tool in a desired tip orientation utilizing the receptacles 142. For a corner unit such as that depicted in FIGS. 1–9, the tools 18 can all be oriented so that they tip rearward toward the back corners 32 and 58, as shown in FIG. 7. This will assist in preventing or inhibiting the unit or device 10 from tipping forward toward the front ends 30 and 56. For devices having other shapes, or for non-corner unit devices, each of the angled surfaces 144 and the receptacles 142 can be constructed and arranged to orient a tool held therein in a particular direction, and different from some or all of the other receptacles 142. This can be done to utilize each tool 18 to distribute and counteract the tipping moment created by other tools 18 stored in the device 10.

The receptacle 142 construction as shown in FIGS. 6–8 can be combined with the previously described toe extension 44 to increase the effectiveness of the anti-tipping characteristics in the device 10. However, each of these two anti-tipping characteristics can be utilized independently as alternatives, if desired.

In another alternative, the blind end surfaces 144 can be cupped and have a contour similar to that of a rounded end 48 of a tool handle 46. Alternatively, the blind end surfaces 144 can be flat and horizontally oriented. The tapered or angled surfaces 144 in the disclosed example are provided to assist in providing an anti-tip characteristic for the storage device 10 as described above.

Since the device 10 in this example is a corner storage unit, the other two sides of the device and the back corner will be placed against wall surfaces, preventing the device from tipping in directions other than forward. When fully loaded and with a number of the tools 18 leaning forward, the center of gravity of the device is changed and can cause the storage device to tip over. The toe extension 44, and in this example, the angled blind end receptacle surfaces 144 in combination will be particularly effective to prevent or inhibit the device from tipping forward.

Figure 10:
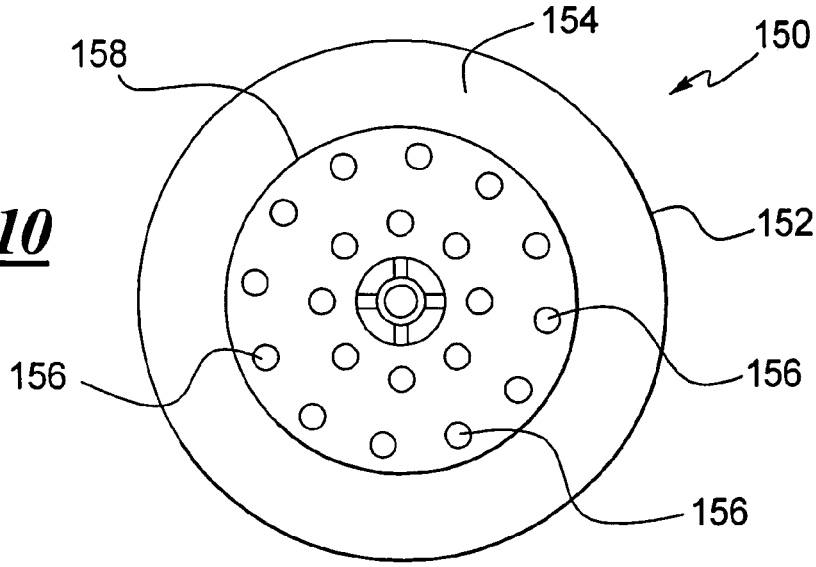
FIG. 10 is a top view of an alternative example of a storage device constructed in accordance with the teachings of the present invention.

If the device has a different shape, such as rectangular, square, oval, or circular, the bottom panel footprint can extend outward beyond the outermost receptacles 42 or 142 , and beyond the upper panel perimeter, if desired, on each side of the panel where necessary to create an anti-tip function. For example, a circular storage device 150 is generically depicted in FIG. 10 and has a base panel 152 with a footprint that defines a perimeter extension 154 with the features similar to the toe extension 44 described above. The perimeter extension 154 projects sufficiently outward beyond the outermost receptacles and openings 156 over the entire circumference to counteract the tipping moment of the loaded device. As noted above, even where the base footprint and a shape of an upper panel 158 are the same (i.e. no projecting portion as defined above), the spacing or gap between the outermost receptacles 156 must be large enough, at least in regions of the base panel susceptible to tipping(i.e., for non-circular or non-triangular devices) to overcome the offset or tipping moment of poorly loaded tools. The device 150 can also incorporate receptacles identical to the receptacles 142 to angle each tool 18 stored therein toward the center of the device to further inhibit tipping over of the unit.

In another anti-tipping alternative, as noted above, the openings 68 and corresponding receptacles 42, for example, can be vertically offset relative to one another to achieve a desired angularity in a stored tool 18. Offsetting an opening 68 relative to its corresponding receptacle 42 can accomplish a similar anti-tipping characteristic created by the angled surfaces 144 of the receptacles 142. Combinations of tapered or cupped receptacle surfaces, perimeter extensions, and offset receptacle alignments can also be utilized.

The shapes of the openings and receptacles can be varied over a panel surface as shown to assist a user in installing a tool. The user can select an opening 68 in the upper panel of a particular shape, insert the handle 46, and make sure the handle end 48 is inserted in the correspondingly shaped receptacle 42 in the base panel 12 simply by locating the matching shape. This feature can help to assure that the device is properly loaded with tools 18.

As will be evident to those having ordinary skill in the art, the base footprint can be shaped differently than the corner adapted triangular shape as shown. For example, the perimeter 26 of the base panel 12 can be rectangular, circular, or other such shape as desired for a particular application.

Although particular examples of an anti-tip tool rack for long handle tools has been disclosed and described herein in accordance with the teachings of the present invention, the scope of coverage of this patent is not limited thereto. On the contrary, this patent covers all embodiments of the teachings of the invention that fairly fall within the scope of permissible equivalents.

What is claimed is:

1. A long handled tool storage device comprising:

a base panel with a top surface, a base perimeter that defines a base panel size and shape, a bottom side arranged so that the base perimeter rests on a ground surface when the storage device is in use, two sides being joined together at first ends thereof to generally define a rear corner, and a front side spanning between second ends of the two sides;

a plurality of tool handle receptacles provided in the base panel and at least recessed downward relative to a plane of the top surface;

a plurality of risers extending upward from the base panel;

an upper panel with a perimeter that defines an upper panel size and shape, the upper panel being supported by the risers above and spaced from the top surface of the base panel;

a plurality of tool handle openings formed through the upper panel; and wherein at least a portion of the front side extends outward, away from the rear corner and beyond a linear reference extending between the second ends of the two sides, and wherein the base panel size and shape and the upper panel size and shape are different at the front side of the base panel and a corresponding front side of the upper panel.

2. A long handled tool corner storage device comprising:

a base panel with a top surface, a base perimeter that defines a base panel size and shape, a rear base corner, a pair of laterally spaced apart front base corners, and a bottom side arranged so that the base panel rests on a ground surface;

a plurality of tool handle receptacles at least recessed downward relative to a plane of the top surface of the base panel;

a plurality of risers extending upward from the base panel;

an upper panel with a perimeter that defines an upper panel size and shape, the upper panel being supported by the risers above and spaced from the top surface of the base panel and having a rear upper corner and a pair of laterally spaced apart front upper corners positioned vertically over the respective rear base corner and front base corners;

a plurality of tool handle openings formed through the upper panel; and a moment negating portion of the base panel positioned along at least a portion of the base perimeter opposite the rear base corner between the front base corners, the moment negating portion extending horizontally forward away from the rear base corner and extending forward relative to a linear reference between the front base corners, and wherein the base panel size and shape are substantially identical to the upper panel size and shape, other than at the moment negating portion of the base panel and a corresponding portion of the upper panel between the front upper corners.

3. A long handled tool corner storage device according to claim 2, wherein the base panel size and shape and the upper panel size and shape are different at the moment negating portion of the base panel and the corresponding portion of the upper panel.

4. A long handled tool corner storage device according to claim 2, wherein the tool handle receptacles in the base panel each have a downward recessed bottom surface relative to a plane of the base panel top surface.

5. A long handled tool corner storage device according to claim 4, wherein the bottom surface of the tool handle receptacles in the base panel are generally parallel to the plane of the base panel top surface.

6. A long handled tool corner storage device according to claim 2, wherein the base panel and upper panel are generally triangular in shape.

7. A long handled tool corner storage device according to claim 2, wherein the plurality of risers, the base panel, and the upper panel are each formed from a plastic material.

* * * * *